US006928834B2

(12) United States Patent
Robertson et al.

(10) Patent No.: US 6,928,834 B2
(45) Date of Patent: Aug. 16, 2005

(54) JEWELLERY SETTING

(75) Inventors: Mark Robertson, Atlantic Highlands, NJ (US); John Humbert, Jr., Morganville, NJ (US)

(73) Assignee: Diamon Alert, LLC, Morganville, NJ (US)

( * ) Notice: Subject to any disclaimer, the term of this patent is extended or adjusted under 35 U.S.C. 154(b) by 157 days.

(21) Appl. No.: 10/468,728

(22) PCT Filed: Feb. 19, 2002

(86) PCT No.: PCT/EP02/01796

§ 371 (c)(1),
(2), (4) Date: Aug. 22, 2003

(87) PCT Pub. No.: WO02/067716

PCT Pub. Date: Sep. 6, 2002

(65) Prior Publication Data

US 2004/0065114 A1 Apr. 8, 2004

(30) Foreign Application Priority Data

Feb. 22, 2001 (GB) ..... 0104314

(51) Int. Cl.[7] ..... A44C 17/02

(52) U.S. Cl. ..... 63/27; 63/26; 63/32; 63/29.1; 63/15; 362/104; 362/571

(58) Field of Search ..... 63/26, 27, 29.1, 63/32, 15; 362/104, 571

(56) References Cited

U.S. PATENT DOCUMENTS 4,093,973 A * 6/1978 Vaagenes ..... 362/104
4,158,197 A * 6/1979 Takagaki ..... 340/574
5,117,338 A * 5/1992 McCrary ..... 362/104
5,323,300 A * 6/1994 McCrary ..... 362/104
5,567,037 A * 10/1996 Ferber ..... 362/104
5,622,062 A * 4/1997 Gong-Hwa ..... 63/15
5,653,524 A * 8/1997 Gray ..... 362/104
5,690,412 A * 11/1997 Sheldon ..... 362/104
5,876,109 A * 3/1999 Scalco ..... 362/104
6,050,695 A * 4/2000 Fromm ..... 362/104
6,540,369 B2 * 4/2003 Granite ..... 362/104
6,659,617 B1 * 12/2003 Michael ..... 362/104
6,833,539 B1 * 12/2004 Maeda ..... 250/214 AL

FOREIGN PATENT DOCUMENTS

DE 27 09 799 A 9/1978
EP 0 565 022 A 10/1993
GB 2319647 A 5/1998

* cited by examiner

*Primary Examiner*—Robert J. Sandy
*Assistant Examiner*—David Reese
(74) *Attorney, Agent, or Firm*—Birch, Stewart, Kolasch & Birch, LLP

(57) ABSTRACT

The invention provides a setting for a precious stone comprising a support for a precious stone; contact means for establishing a contact between the support and a stone within the support; a detector for detecting a break in the contact; and an emitter for emitting a signal on detection of the break in the contact. The setting provides a means of alerting wearers of an item of jewellery that the precious stone is loose within its support.

41 Claims, 5 Drawing Sheets

JEWELLERY SETTING

This application is the national phase under 35 U.S.C. § 371 of PCT International Application No. PCT/EP02/01796 which has an International filing date of Feb. 19, 2002, which designated the United States of America.

TECHNICAL FIELD

The present invention relates to items of jewellery, in particular to a device for alerting wearers that a precious stone is loose within its setting.

BACKGROUND TO THE INVENTION

Personal jewellery, such as rings, necklaces, bracelets, etc., are expensive items which can be of great value to their owners. Items of jewellery typically comprise a precious stone set in a mounting which itself may be composed of a precious metal, such as gold, platinum or silver. Both the gem stone and the mounting may be extremely expensive individually, but the combination may be crafted together by a skilled smith to produce a work of extreme value. Furthermore, as items of jewellery are often given as gifts to commemorate special occasions, such as birthdays, anniversaries, engagements and weddings, they are frequently of significant sentimental value to the wearer.

A common problem experienced by wearers and owners of items of jewellery is that the precious gem stone becomes loose in its setting and may become dislodged. This may occur due to the age of the jewellery or if it is subjected to a jolt or shock, for example if a ring falls from the wearer's finger onto the ground. Typically the gem stone will 'work loose' over an extended period of time, following such a jolt or shock. The wearer of the jewellery is generally unaware that the precious stone has become dislodged from its setting and consequently doesn't realise that there is a problem. Unfortunately the result all too often is that the precious stone eventually works free of the setting and is lost, causing both financial and often personal loss for the wearer. Although the owner may replace the stone (often at significant expense) with a similar gem, the stone may have held significant sentimental value and consequently can never truly be replaced.

The present invention addresses the problem of alerting the wearer or owner of an item of jewellery to the fact that the precious stone has become loose or dislodged from its setting. Until this time, the only method of checking that the stone is firmly held within its setting is for an experienced jeweller or smith to inspect it. This can be both expensive and time-consuming, relying on the owner visiting the jewellers, and may not prevent losses occurring between such visits. The present invention provides a means of immediately alerting the wearer the moment that the stone becomes loosened or dislodged from its setting so that remedial action may be taken swiftly.

SUMMARY OF INVENTION

According to one aspect of the present invention, there is provided a setting for a precious stone comprising a support for a precious stone; contact means for establishing a contact between the support and a stone within the support; a detector for detecting a break in the contact; and an emitter for emitting a signal on detection of the break in the contact.

Suitably, the precious stone is selected from the group consisting of diamond, sapphire, pearl, ruby, amethyst, topaz, garnet, aquamarine, emerald, peridot, opal and turquoise.

In one aspect, the stone comprises an electrically conductive material. Suitably, the conductive material comprises diamond.

Suitably, the support comprises one or more prongs. Preferably, the support comprises a precious metal. More preferably, the metal is selected from the group consisting of gold, silver and platinum.

In one aspect, the contact means is in the form of means for establishing an electrical contact between the support and the stone. In particular, there is established a constant electrical flow contact state and the detector detects a break in that state.

Suitably, the contact means comprise an electrically conductive material. Preferably, the conductive material comprises a metal wire or plurality of metal wires. More preferably, the metal is selected from the group consisting of gold, silver, platinum, iron and alloys thereof.

Suitably, the contact means establishes an electrical contact between the support and the stone.

In one aspect, the support, contact means and stone form an electrical circuit and the detector detects a break in the electrical circuit. Preferably, the detector comprises a switch. More preferably, the switch comprises a semiconductor device or a transistor.

In another aspect, the contact is in the form of means for establishing a physical contact between the support and the stone. In particular, there is established a constant physical contact state and the detector detects a break in that state.

Suitably, the detector detects a break in the physical contact. Preferably, the detector comprises a switch in communication with a sensor. More preferably, the switch comprises a semi-conductor device or transistor.

In a further aspect, the sensor is sensitive to stimuli in the form selected from the group consisting of pressure, light, electricity, resonance and sound. These sensors will detect any change in physical contact between the support and the precious stone. Thus, for example, a pressure sensor will register any change in mechanical pressure exerted between the support and the precious stone if the stone becomes dislodged in the setting. Similarly, a light sensitive sensor will detect any incident light falling onto its surface if the stone becomes dislodged.

Resonance sensors are sensitive to changes in the resonant frequency of the precious stone in the support due to a loosening therebetween. Acoustic or sound sensors emit acoustic signals between the support and the precious stone, being sensitive to any change in the reflected signal due to loosening of the stone.

In one aspect, the sensor forms part of a Micro-ElectroMechanical System (MEM). A range of different sensors, including light and magnetic sensors, may be employed, but pressure sensors are particularly suitable for this purpose. MEMS are well known in the art, being used in a variety of applications in the automobile, pharmaceutical and printing industries. Thus, for example, MEMS are employed as 'accelerometers' to detect impact and control air bag release in automobile collisions and as blood pressure sensors during medical surgery.

In a further aspect, the contact is in the form of means for establishing a fluid pressure contact between the support and the stone. In particular, there is established a constant fluid pressure state and the detector detects a break in that state. Any suitable pressure detector may be employed including a silicon-based pressure sensor or compressed air pressure sensor.

In a preferred aspect herein, a constant vacuum state is established and the detector acts such as to detect the flow of air which accompanies the disruption of that vacuum state. In this aspect, the detector may comprise a zinc air battery (as described below) which generates electrical power only in the presence of air and not when in an evacuated environment.

In a still further aspect, the contact is in the form of means for establishing an optical contact between the support and the stone. In particular, there is established a constant optical state and the detector detects a break in that state. The break may for example, be sensed by a break in optical characteristics such as refractivity or reflectivity. Any suitable optical detector may be employed including one employing known optical sensors which typically employ an optical transmitter and receiver set up.

In one particular optical aspect, a transmitter-receiver pair is optically attached to the surface of the precious stone. The optical path between the pair is broken if the contact between the stone and the support is broken.

In a further aspect, the contact is in the form of means for establishing a conductance contact between the support and the stone. In particular, there is established a constant electrical conductivity state and the detector detects a break in that state. Any suitable detector may be employed for detecting the break.

In a further aspect, the contact is in the form of means for establishing a capacitative contact between the support and the stone. In particular, there is established a constant capacitative state and the detector detects a break in that state. Any suitable capacitance detector may be employed for detecting the break.

Suitably, the setting additionally comprises a power source for powering the detector and/or the emitter. Preferably, the power source is selected from the group consisting of battery (e.g. a lithium battery), fuel cell and solar cell.

Suitably, the powered elements of the setting (e.g. the detector and the emitter) have low power consumption. Suitably, the required power consumption is less than 500 nA, preferably less than 200 nA.

In one preferred aspect, the battery is a zinc air battery. A zinc air battery has the functional characteristic that it generates power only when exposed to air. Thus, when such a battery is kept in an evacuated environment no power is generated, but when air is introduced power is generated.

Suitably, the emitter is capable of emitting energy in the form selected from the group consisting of electro-magnetic radiation, sound, electrical, kinetic and thermal energy. Thus, for example, the emitter may produce heat, kinetic or electrical energy to instantly alert the wearer of the jewellery that the precious stone is loose within its setting. The wearer would therefore experience a mild burning, vibrational or shock sensation and, would immediately remove and inspect the item of jewellery.

Preferably, the emitter emits light or sound energy continuously or intermittently. More preferably, the emitter is a light emitting diode. More preferably, the emitter emits coloured light. In aspects, the wearer of the item of jewellery, such as a ring, would see the change in colour of the precious stone (or the intermittent lighting) and have the setting tested by a jeweller or smith. It may be appreciated that the colour and intensity of emitted light will need to an extent, be tailored to qualities of the precious stone. For example, if the stone is a ruby which of course, is red in colour, the colour and intensity of the emitter will need to be adapted to take account of that red colour.

In another aspect, the emitter emits radio-frequency energy. The radio-frequency signal may be detected by a detector distant from the item of jewellery. This system has the advantage in that the radio-frequency detector can be used to locate a lost item of jewellery which has fallen from the wearer and in which the stone has become loosened in the fall. Emitter systems which employ the Global Positioning System (GPS) standard are envisaged herein.

In one aspect, the contact means, the emitter and/or the detector are embedded in a plastic matrix. Preferably, the matrix is soluble in an organic solvent. More preferably, the matrix is soluble in dilute acid or alkali.

In other aspects, the elements (e.g. the contact means, emitter and/or detector) of the setting are fitted manually. The setting will shaped and/or otherwise configured to readily accommodate the elements and to facilitate assembly of the setting.

Methods involving retro fitting of the elements of the setting herein are envisaged, for example whereby an existing ring is modified to accept the required elements of the setting of the present invention. The use of purpose-built jewellery settings is also envisaged.

In one aspect, the setting additionally comprises a precious stone within the support. Preferably, the precious stone is selected from the group consisting of diamond, sapphire, pearl, ruby, amethyst, topaz, garnet, aquamarine, emerald, peridot, opal and turquoise.

According to one aspect of the present invention, there is provided an inlay for a setting for a precious stone comprising a basket, the basket comprising a plastic matrix and embedded therein contact means for establishing a contact between a precious stone within the support and an emitter for emitting a signal on detection of a break in the contact; and a detector for detecting the break in the contact.

According to another aspect of the present invention, there is provided an item of jewellery comprising a setting according to the present invention affixed to a mounting. Preferably the mounting is selected from the group consisting of ring, necklace, bracelet, brooch, earring, tiepin, cuff link, necklace and pendant.

In aspects, the power source (e.g. battery) is located in a cavity (e.g. a hollowed out section) within the item of jewellery. In a specific example, a battery is located in a hollowed part of the band of a ring.

According to a further aspect of the present invention, there is provided a method of manufacturing an item of jewellery according to the present invention comprising the following steps:

a) affixing a setting according to the present invention onto a mounting according to the present invention; and b) dissolving the plastic matrix with a solvent selected from the group consisting of organic solvent, dilute acid and dilute alkali.

In another aspect of the present invention, there is provided a method of alerting wearers of an item of jewellery according to the present invention that a precious stone is loose within the setting comprising emitting energy in the form selected from the group consisting of electro-magnetic radiation, sound, electrical, kinetic and thermal energy from the emitter.

In a further aspect of the present invention, there is provided a kit of parts, comprising a setting according to the present invention and a mounting for the setting.

BRIEF DESCRIPTION OF DRAWINGS

Preferred embodiments of the present invention will now be described with reference to the accompanying drawings in which.

DETAILED DESCRIPTION OF THE DRAWINGS

Figure 1A:
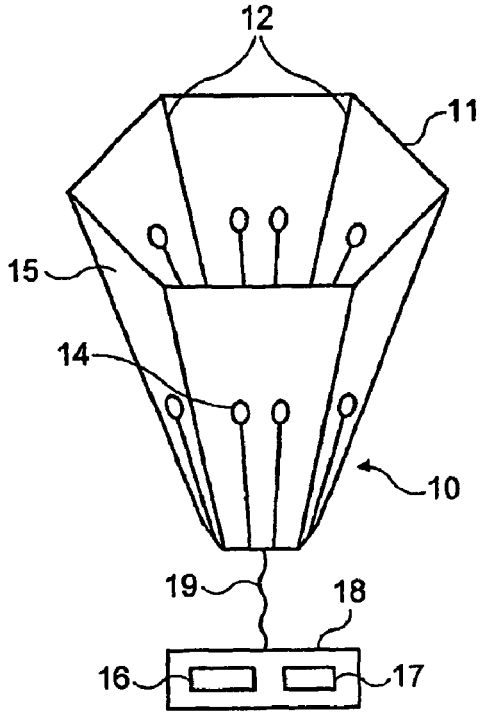
FIG. 1*a* is perspective view of a number of key components a setting according to the present invention.

In FIG. 1*a* it can be seen that contact means 12 (which are electrically conductive wires in FIGS. 1 & 2) and emitters 14 are supported in plastic matrix 11 of inlay 10. The conductive wires 12 and emitters 14 are connected to power supply 16 (such as a battery) and detector 17 (e.g. a transistor) within a casing 18 by wire 19. The power supply 16 and detector 17 are also connected within casing 18. In the example shown, the emitters 14 are light emitting diodes but it will be understood, other forms of emitters (such as sound emitters) are possible.

Figure 1B:
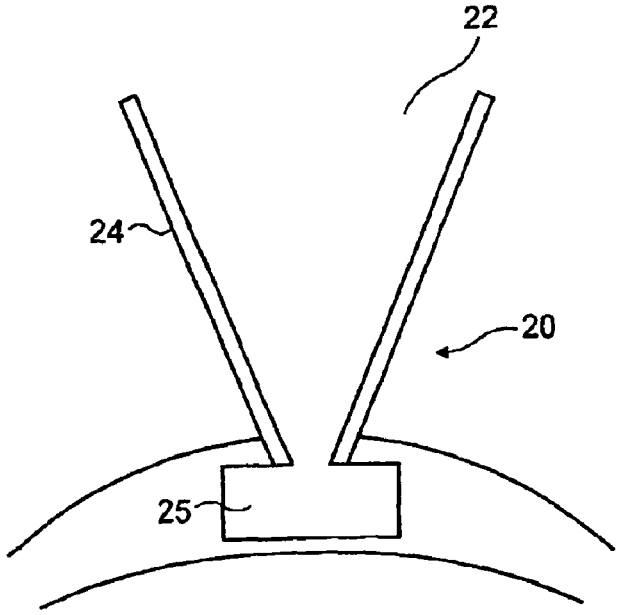
FIG. 1*b* is a sectional view of a mounting and setting according to the present invention.

FIG. 1*b* depicts a sectional view of a mounting 20 (in the form of a dress ring e.g. a solitaire ring) and setting 22 for a precious stone (not shown). Setting 22 comprises a number of prongs 24 for securing the stone by crimping thereto or suitable means. The base of the mounting 20 is hollowed 25 for receipt of casing 18. The components shown in FIG. 1*a* are placed within setting 22 such that the casing 18 is held within hollow 25 and each conductive wire 12 is in physical contact with a prong 24. The wires 12 and emitters 14 are secured into position by bonding with a suitable adhesive. The precious stone (130, FIG. 2) is then inserted into setting 22 and fixed into position by crimping of the prongs 24.

In a variation of the example shown in FIGS. 1*a* and 1*b*, the plastic matrix 11 element is not present. The elements of the setting are assembled manually and at least, the power supply 16 occupies hollowed out part of the ring.

Figure 2:
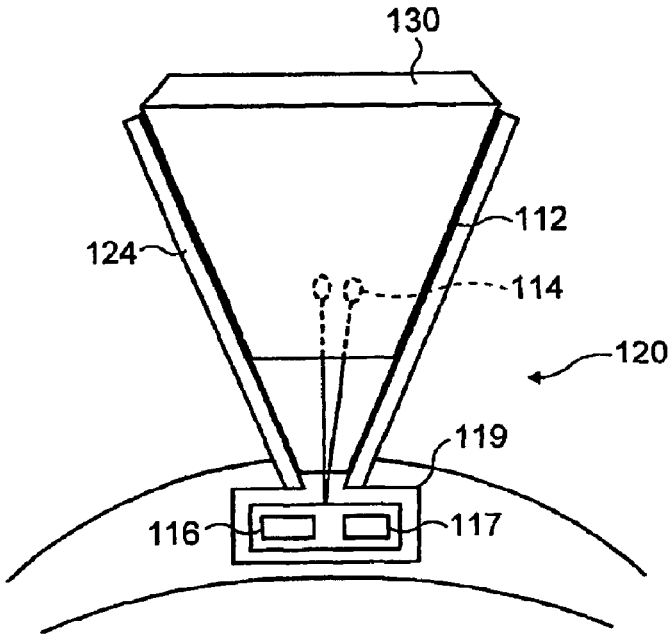
FIG. 2 is a sectional view of a first item of jewellery according to the present invention.

FIG. 2 shows a sectional view of an item of jewellery with precious stone 130 set in mounting 120 (in the form of a dress ring). Contact means, in the form of conductive wires 112, are bonded to prongs 124 which are then crimped to secure the precious stone 130 (e.g. a diamond) into position. The crimping establishes contact between the prongs 124, conductive wires 112 and stone 130. The power source 116 and detector (e.g. a transistor) 117 are connected to the conductive wires 112 and emitters 114 by a wire 119. The plastic matrix 11 (FIG. 1*a*) supporting the conductive elements 112 and emitters 114 is then dissolved with an appropriate solvent such as carbon tetrachloride.

In the position shown, with contact established between the power source 116, prongs 124, conductive wires 112 and stone 130, an electrical circuit is set up. Detector 117 monitors the continuity of the electrical circuit. If the circuit is broken, for example by a prong 124 losing contact with stone 130 following a jolt, the detector 117 enables the power supply 116 to energise emitters 114. The emitters 114 emit a pulsating coloured light (not shown) which will be radiated through the stone 130. The change in colour of the stone 130 and pulsating emission will alert the wearer that the stone is loose within its setting 120 and appropriate action may then be taken.

Figure 3:
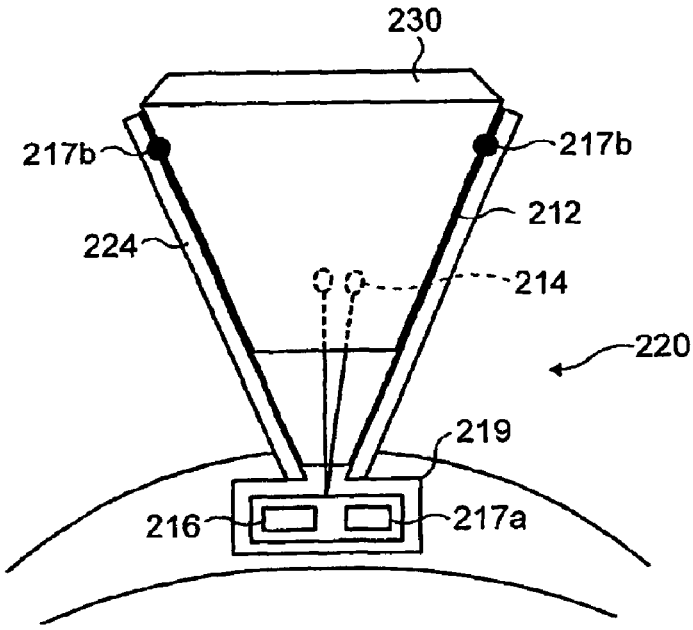
FIG. 3 is a sectional view of a second item of jewellery according to the present invention.

Another embodiment of the present invention is shown in FIG. 3, again in sectional view. The component parts of the dress ring 220 are identical to those shown in FIG. 2, except that the detector is composed of transistor 217*a* and pressure sensors 217*b*. The sensors 217*b*, which are depicted in enlarged and simplified form in FIG. 3, are in communication with the transistor 217*a* via contact means 212 which are positioned along the length of prongs 224. Once the precious stone 230 is crimped into position, as discussed above, contact is established between the sensor 217*b*, prong 224 and stone 230. The sensors 217*b* detect any change in pressure resulting from the loosening of precious stone 230 from prongs 224. At a predetermined change in pressure, sensor 217*b* signals transistor 217*a* to allow battery 216 to power emitters 214. Light energy is emitted through the stone 230 to alert the wearer that the stone has become dislodged in its setting 220.

Figure 4:
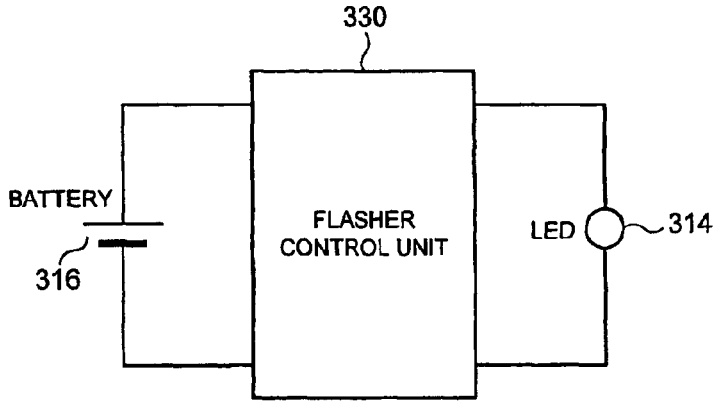
FIGS. 4 and 5 show circuit diagrams for use in accord with the present invention.
Figure 5:
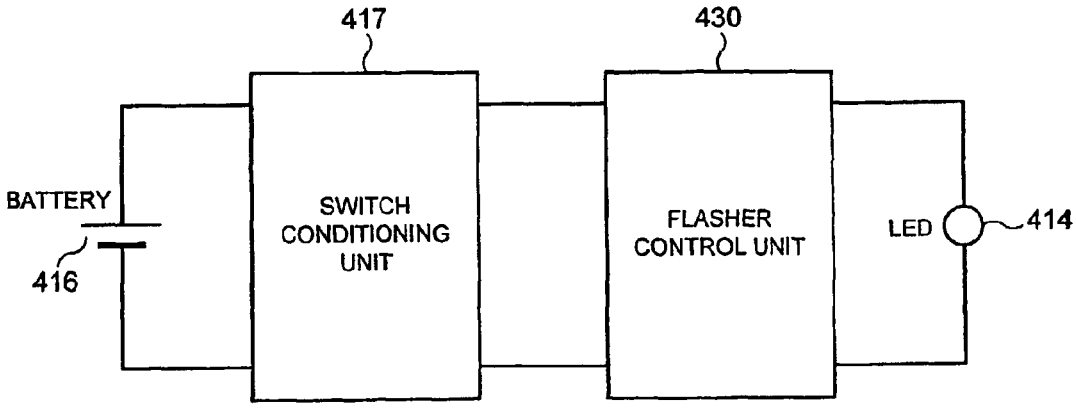

FIGS. 4 and 5 show suitable circuits for use herein. The circuit of FIG. 4 may be seen to comprise a power source 316 in the form of a battery (e.g. a zinc air battery); an emitter 314 in the form of an LED; and a flasher control unit 330. The flasher control unit 330 comprises as sub-modules a timer; a multiplier and a driver, all of which in combination act to enable control of the emitter (flasher) 314. The timer sub module of the control unit 330 may be configured to enable timed/repeated flashing on and off of the LED emitter 314. The respective sub-modules are highly integrated (e.g. in a single chip) for power efficiency of the control unit 330.

The circuit of FIG. 5 comprises the basic battery power source 416; LED emitter 414; and flasher control unit 430 components of the circuit of FIG. 4, each of which will have similar form/structure to those of FIG. 4. The circuit of FIG. 5 however, also incorporates a switch conditioning unit 417, which comprises as sub-modules a comparator; a timer; and a flasher interface. The switch conditioning unit 417 acts such as to sense the state of the switch (with minimum current drain) and switch power to the LED emitter 414 when the switch is triggered.

The comparator sub module has the task of checking the state of the switch. This requires a current of the order of 10 $\mu$A through the switch and sensing the voltage across it. The timer sub module provides timing signals to the comparator to power up the sensing circuit for a short period followed by a period of rest. This reduces average current drain and therefore improves battery life. Once the circuit is triggered, the flasher control unit 430 is activated by the flasher interface sub module.

The sub module functions of the switch conditioning unit 417 will not exist as separate parts but be integrated into a single unit 417. In aspects, the switch conditioning unit 417 and flasher control unit 430 may also be integrated.

Figure 6:
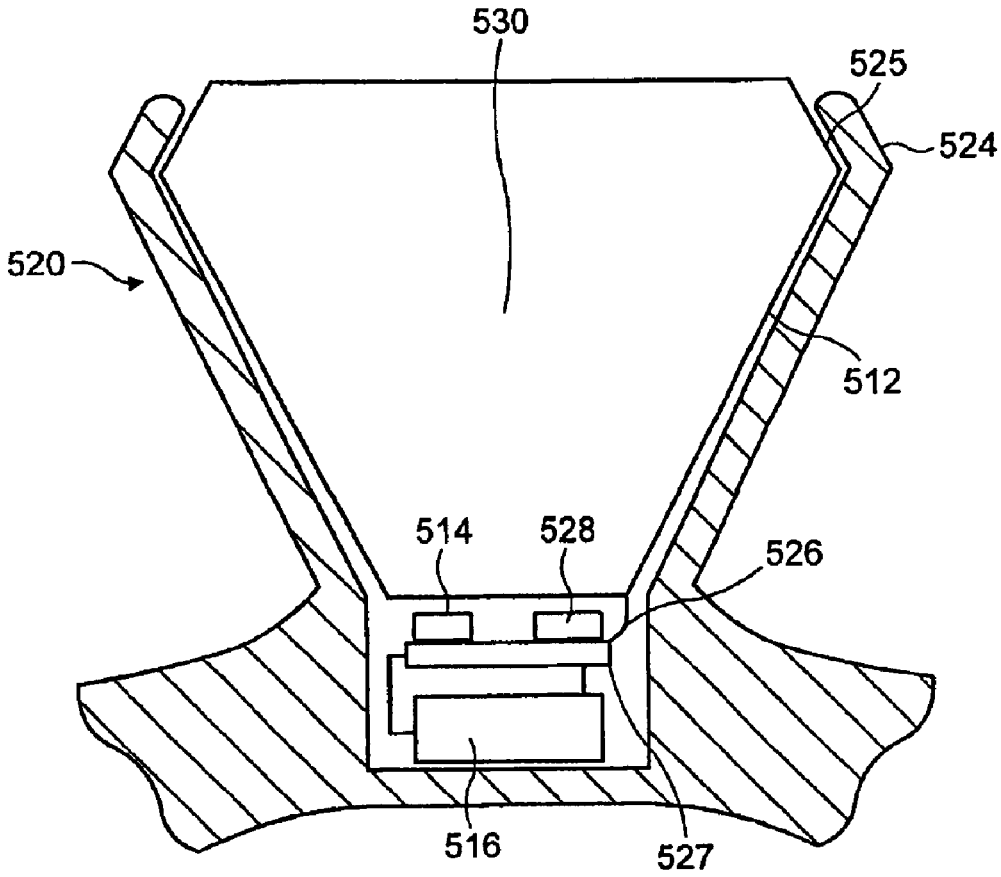
FIG. 6 is a sectional view of a third item of jewellery according to the present invention.

FIG. 6 shows a sectional view of another item of jewellery, in the form of a ring, in accord with the present invention. Precious stone 530 is set in mounting 520. A gold wire 512 runs adjacent to the precious stone 530 such that a first end of the wire 512 makes contact with holding claw 524 at three-way electrical contact position 525. In alternative embodiments, one or more further gold wires are included to enable the establishment of one or more further wire-claw-stone three way electrical contacts. The second end of the wire 512 connects to integrated circuit 528 via first switch connector 526. The integrated circuit 528, in turn, connects to the claw 524 via second switch connector 527. The integrated circuit 528 (e.g. as in FIGS. 4 and 5) is powered by battery 516 (e.g. a zinc air battery, which is preferred because of its high power density in relation to its size). The battery 516 is permanently connected to the integrated circuit 528 by two wires. In the embodiment shown, the battery 516 is isolated from the ring, but in alternatives one of the wires connecting the battery 516 to the integrated circuit 528 may be substituted by the body of the ring and the battery 516 need not then be isolated. Emitter 514 in the form of an LED also connects to the integrated circuit 528.

In use, the first switch connector 526 is normally closed and electrical contact is thereby established between the battery 516, wire 512, claw 524 and stone 130. If the electrical contact is broken such as when claw 524 loses contact with stone 530 following a jolt, the first switch connector 526 opens. The opening of the switch 526 is detected by the integrated circuit 528 and power directed to LED emitter 514 which emits coloured warning light through the stone 530. The change in colour of the stone 530 alerts the wearer that the stone is loose within its setting 520 and appropriate action may then be taken.

Figure 7A:
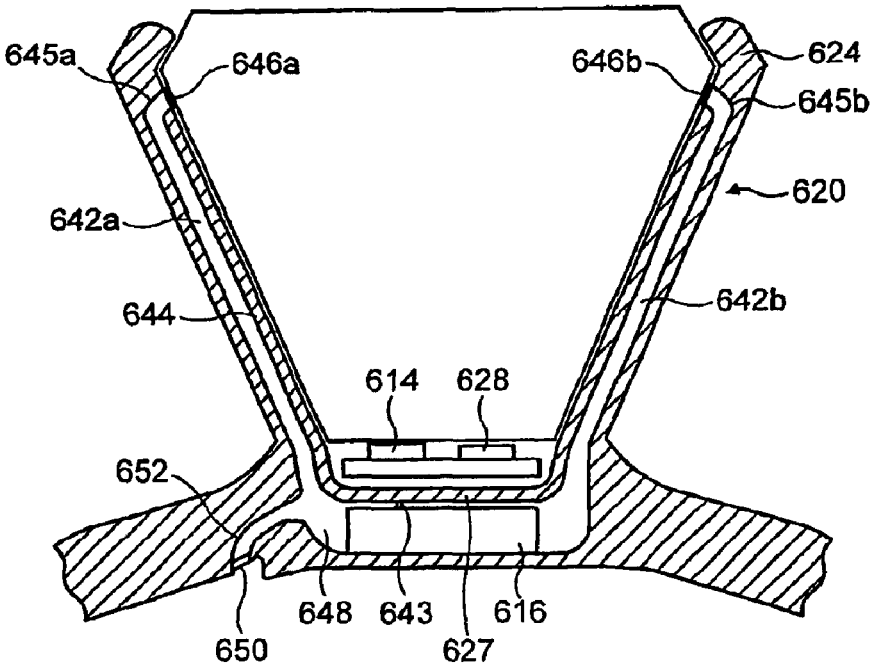
FIG. 7*a* is a sectional view of a fourth item of jewellery according to the present invention.

FIG. 7*a* shows a sectional view of another item of jewellery, in the form of a ring, in accord with the present invention. Precious stone 630 is set in mounting 620 comprising a holding claw 624 having holding arms 645*a*, 645*b*. Normally evacuated 30 airflow channels 642*a*, 642*b* are located adjacent to the precious stone 630 and seals 646*a*, 646*b* provided at a first end of each airflow channel 642*a*, 642*b* where the stone 630 makes contact with each respective arm 645*a*, 645*b* of holding claw 624. The second end of each normally evacuated air channel 642*a*, 642*b* connects with zinc air battery 616 which sits in normally evacuated chamber 648. In normal operation, a zinc air battery 616 does not produce any power in the absence of exposure to air. Thus, whilst air is absent from the chamber 648 and airflow channels 642*a*, 642*b* the battery 616 is not drawing power.

The precious stone 63*d* may also be seen to sit in cradle 644 which encloses and in effect, isolates integrated circuit 628 located at the base of the stone 630. Emitter 614 in the form of an LED connects to the integrated circuit 628. The integrated circuit 628, in turn, connects to the battery 616 via air-tight (i.e. sealed) electrical connection 627. The battery 616 also connects to the cradle 644 through wires 643.

Figure 7B:
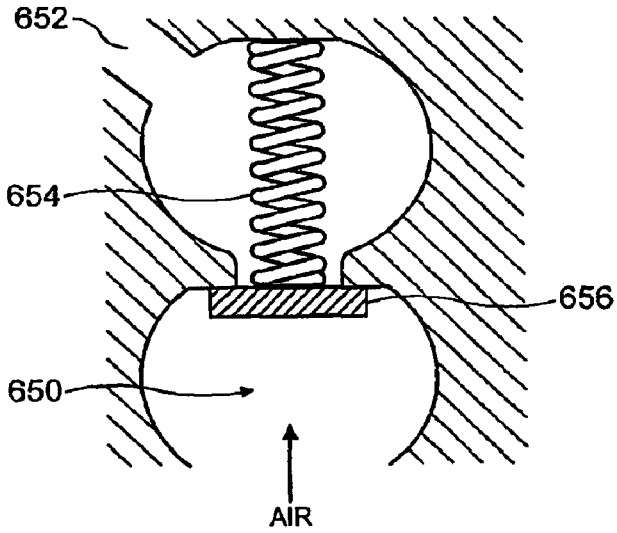
FIG. 7*b* is a sectional view of a detail of the item of jewellery of FIG. 7*a*.

In an optional aspect shown in more detail in FIG. 7*b*, the ring is provided with a poppet valve 650 located such as to enable controlled flow of air through valve channel 652 into the normally evacuated airflow channels 642*a*, 642*b* and battery chamber 648. The poppet valve 650 comprises a spring 654 mounted poppet seal 656. The poppet valve 650 can be used to perform two functions. Firstly, it may be configured to open up when the vacuum in the channels 642*a*, 642*b* and chamber 648 is broken, thereby increasing the airflow to the zinc air battery 616. Secondly, the poppet valve 650 may be used to assist in evacuation of the airflow channels 642*a*, 642*b* and battery chamber 648 during manufacture or maintenance.

In use, the seals 646*a*, 646*b* are normally closed and a vacuum exists within the airflow channels 646*a*, 646*b* and battery chamber 648. The zinc air battery 616 therefore draws no power. If any seal 646*a*, 646*b* is broken such as when claw arms 645*a*, 645*b* lose contact with the stone 630 following a jolt, airflows into the previously evacuated regions 645*a*, 645*b*, 648 and the battery 616 starts to power the device components. The presence of the poppet valve 650 may be used enhance the airflow to the battery 616, thereby enhancing power production. The integrated circuit 628 is powered up by the battery 616 and power directed thereby to LED emitter 614 which emits coloured warning light through the stone 630. The change in colour of the stone 630 alerts the wearer that the stone is loose within its setting 620 and appropriate action may then be taken.

In variations of the rings of FIGS. 6, 7*a* and 7*b* the battery 516, 616 is located within a hollowed out part of the ring such as a hollow in the band of the ring. The relevant circuitry arrangement will be modified accordingly.

It will be understood that the present disclosure is for the purpose of illustration only and the invention extends to modifications, variations and improvements thereto.

The application of which this description and claims form part may be used as a basis for priority in respect of any subsequent application. The claims of such subsequent application may be directed to any feature or combination of features described therein. They may take the form of product, method or use claims and may include, by way of example and without limitation, one or more of the following claims:

What is claimed is:

1. A setting for a precious stone comprising a support for a precious stone;

contact means for establishing a contact between said support and a stone within the support;

a detector for detecting a break in said contact;

whereby an emitter emits a signal on detection of said break in the contact between said support and stone within the support.

2. A setting according to claim 1, wherein the support comprises one or more prongs.

3. A setting according to either of claim 1 or 2, wherein the support comprises a precious metal selected from the group consisting of gold, silver and platinum.

4. A setting according to claim 1, wherein the contact means comprises electrical contact means for establishing an electrical contact between the support and the stone.

5. A setting according to claim 4, wherein the electrical contact means comprises an electrically conductive material.

6. A setting according to claim 5, wherein said electrically conductive material comprises a metal wire or plurality of metal wires.

7. A setting according to claim 6, wherein said metal is selected from the group consisting of gold, silver, platinum, iron and alloys thereof.

8. A setting according to any one of claims 4 through 7, wherein the detector is an electrical detector for detecting a break in an electrical circuit state existing between the precious stone, support and electrical contact means.

9. A setting according to claim 8, wherein the electrical detector comprises a switch.

10. A setting according to claim 9, wherein said switch comprises a semi-conductor device or a transistor.

11. A setting according to claim 1, wherein the contact means comprises physical contact means for establishing a physical contact between the support and the stone.

12. A setting according to claim 11, wherein the detector is a physical detector for detecting a break in a physical state existing between the precious stone, support and electrical contact means.

13. A setting according to claim 12, wherein the physical detector comprises a switch in communication with a sensor.

14. A setting according to claim 13, wherein said switch comprises a semi-conductor device or a transistor.

15. A setting according to either of claim 13 or 14, wherein said sensor is sensitive to stimuli in the form selected from the group consisting of pressure, light, electricity, resonance, sound and magnetism.

16. A setting according to claim 13, wherein the sensor forms part of a Micro-ElectroMechanical System (MEMs).

17. A setting according to claim 1, wherein the contact means comprises fluid pressure contact means for establishing a constant fluid pressure state between the support and the stone.

18. A setting according to claim 17, wherein said constant fluid pressure state is a constant vacuum state.

19. A setting according to claim 18, wherein the detector detects the flow of air which accompanies a disruption of the vacuum state.

20. A setting according to claim 19, wherein the detector comprises a zinc air battery.

21. A setting according to claim 1, wherein the contact means comprises optical contact means for establishing an optical contact between the support and the stone.

22. A setting according to claim 21, wherein the detector comprises an optical sensor including an optical transmitter-receiver pair.

23. A setting according to claim 22, wherein said optical transmitter-receiver pair is optically attached to the surface of the precious stone.

24. A setting according to claim 1, wherein the contact means comprises conductance means for establishing a conductance contact between the support and the stone.

25. A setting according to claim 1, wherein the contact means comprises capacitative means for establishing a capacitative contact between the support and the stone.

26. A setting according to claim 1, wherein the emitter is capable of emitting energy in the form selected from the group consisting of electro-magnetic radiation, sound, electrical, kinetic and thermal energy.

27. A setting according to claim 26, wherein the emitter comprises a light emitting diode.

28. A setting according to claim 1, additionally comprising a power source for powering the detector and/or the emitter.

29. A setting according to claim 28, wherein said power source is selected from the group consisting of battery, fuel cell and solar cell.

30. A setting according to claim 29, wherein said battery is a zinc air battery.

31. A setting according to claim 1, wherein the contact means, the emitter and/or the detector are embedded in a plastic matrix.

32. A setting according to claim 31, wherein said matrix is soluble in a medium selected from the group consisting of an organic solvent, dilute acid and alkali.

33. A setting according to claim 1, additionally comprising a precious stone within the support.

34. A setting according to claim 33, wherein the precious stone is selected from the group consisting of diamond, sapphire, pearl, ruby, amethyst, topaz, garnet, aquamarine, emerald, peridot, opal and turquoise.

35. An inlay for a setting for a precious stone comprising a basket, said basket comprising a plastic matrix and embedded therein contact means for establishing a contact between a support and a precious stone within the support whereby an emitter emits a signal on detection of a break in said contact between said support and stone within support; and a detector for detecting said break in the contact.

36. An item of jewellery comprising a setting according to claim 1; and a mounting for said setting.

37. An item of jewellery according to claim 36, wherein said mounting is selected from the group consisting of ring, necklace, bracelet, brooch, ear ring, tie pin, cuff link, necklace and pendant.

38. An item of jewellery according to either of claim 35 or 36, additionally comprising a power source, wherein said power source is located in a cavity within the item of jewellery.

39. A method of manufacturing an item of jewellery according to claim 36 comprising the steps of:

a) affixing a setting wherein the contact means, the emitter and/or the detector are embedded in a plastic matrix or wherein said matrix is soluble in a medium selected from the group consisting of an organic solvent, dilute acid and alkali onto a mounting; and b) dissolving the plastic matrix with a solvent selected from the group consisting of organic solvent, dilute acid and dilute alkali.

40. A method of alerting wearers of an item of jewellery according to claim 36 that a precious stone is loose within the setting comprising emitting energy in the form selected from the group consisting of electro-magnetic radiation, sound, electrical, kinetic and thermal energy from the emitter.

41. An item of jewellery in kit of parts form comprising a setting according to claim 1 and a mounting for said setting.

* * * * *

UNITED STATES PATENT AND TRADEMARK OFFICE

CERTIFICATE OF CORRECTION

PATENT NO. : 6,928,834 B2
DATED : August 16, 2005
INVENTOR(S) : Mark Robertson et al.

It is certified that error appears in the above-identified patent and that said Letters Patent is hereby corrected as shown below:

Title page,
Item [30], Foreign Application Priority Data, add the following:
-- Jun. 15, 2001 (GB)…….. 0114622.4 --.

Signed and Sealed this

Seventh Day of March, 2006

JON W. DUDAS
*Director of the United States Patent and Trademark Office*